United States Patent [19]

Kovar et al.

[11] 4,177,660

[45] Dec. 11, 1976

[54] APPARATUS FOR FEEDING WORKPIECES FOR CROSS WEDGE ROLLING

[75] Inventors: Jan Kovar, Ricmanice; Jan Drkal, Brno, both of Czechoslovakia

[73] Assignee: Vyzkumny ustav tvarecich stroju a technologie tvareni, Brno, Czechoslovakia

[21] Appl. No.: 890,023

[22] Filed: Mar. 24, 1978

[51] Int. Cl.[2] ..... B21H 9/00

[52] U.S. Cl. ..... 72/108; 72/109

[58] Field of Search ..... 72/102, 105, 106, 107, 72/108, 109

[56] References Cited

U.S. PATENT DOCUMENTS

| | | | |
|---|---|---|---|
| 1,370,978 | 3/1921 | Long | 72/108 |
| 2,048,917 | 7/1936 | Brandt et al. | 72/108 |
| 2,737,833 | 3/1956 | Plagemann et al. | 72/108 |
| 3,147,649 | 9/1964 | Hubl et al. | 72/108 |
| 3,552,167 | 1/1971 | Bergi et al. | 72/108 |

*Primary Examiner*—Lowell A. Larson

[57] ABSTRACT

Workpieces for cross wedge rolling are fed first to an auxiliary trough provided with a sliding gate for removal of workpieces in case of an interruption of the operation of the rolling stand; the workpieces are fed from the auxiliary trough into a stand-by trough to be fed between the rolls of the rolling stand.

6 Claims, 3 Drawing Figures

APPARATUS FOR FEEDING WORKPIECES FOR CROSS WEDGE ROLLING

BACKGROUND OF THE INVENTION

The invention relates to cross wedge rolling. The object of the invention is the provision of an improved apparatus for feeding workpieces between the rolls of a rolling stand.

By the expression "cross wedge rolling" as used herein there is meant a rolling process in which a workpiece is rolled between opposing rolls with the axis of the workpiece extending generally parallel to the axes of the rolls.

For this purpose, the application of a stand-by trough has already been proposed, such stand-by trough being situated close to the rolls and approximately in the rolling axis, into which trough the workpiece is supplied by some feeding means and from which it is fed between the rolls of the machine.

This proposal supposes that the workpiece is guided in the machine in the course of rolling on its extremities by centering means, one of which is also the feeding means. A drawback of this proposed arrangement is that a shorter time is available for feeding or a further part of a revolution of the rolls is required. In addition, an interruption of feeding into the machine is impossible if the workpieces are received continuously, for instance from a heating oven.

SUMMARY OF THE INVENTION

It is an object of this invention to eliminate this drawback and to provide feeding means which enable the capacity of the rolling stand to be used to the utmost. According to this invention, a stand-by trough is provided substantially in the rolling axis of the machine, with an auxiliary trough above the rolling axis, a supply chute above the auxiliary trough for the supply of workpieces to the auxiliary trough and terminating in this auxiliary trough, with a discharge opening in the auxiliary trough at the end of said chute closed by a sliding gate controlled in dependence of the operation of the rolling stand, and power cylinders for shifting the workpieces in the auxiliary trough and in the stand-by trough.

DESCRIPTION OF THE DRAWING

An exemplary embodiment of the apparatus of this invention is shown in the attached drawing, in which.

DESCRIPTION OF THE PREFERRED EMBODIMENT

Figure 1:
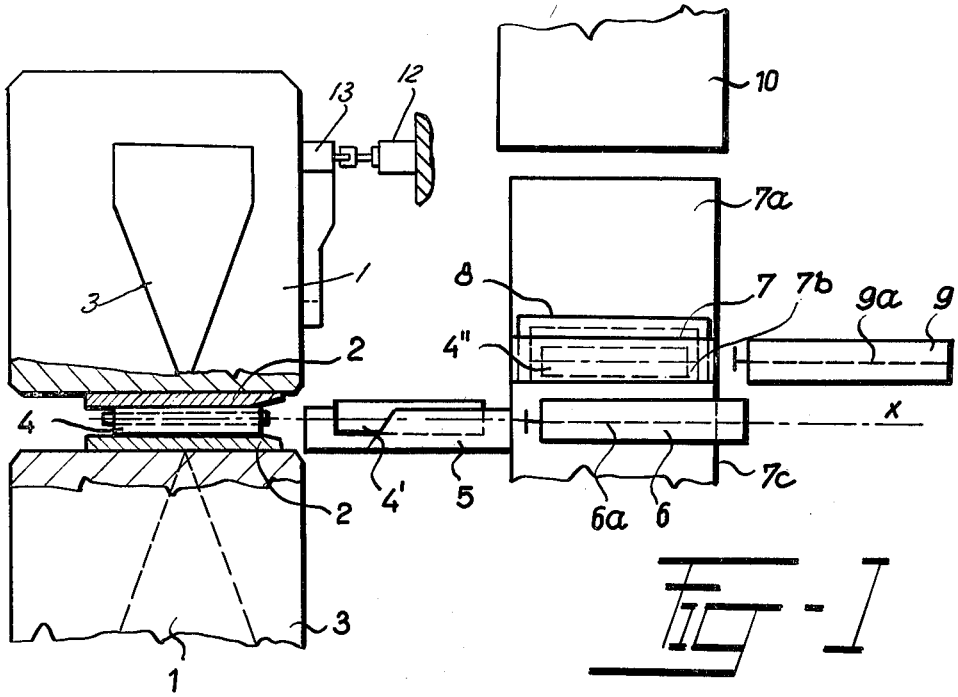
FIG. 1 is a diagrammatic view in elevation of the machine.
Figure 2:
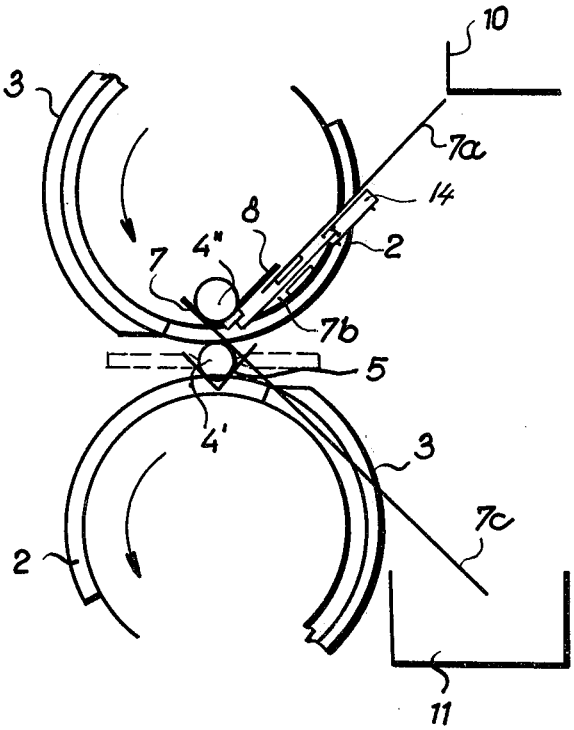
FIG. 2 is a diagrammatic side view in the direction of the rolling axis.

Referring to FIGS. 1 and 2, guiding segments 2 and rolling tools 3 are fixed on opposed parallel rolls 1 of the machine. The cylindrical workpiece 4 is inserted by shifting it in direction of the axis x of rolling between the rotating rolls 1 so that it is guided, in the course of its being inserted, by the segments 2, which are beveled and preferably also by guide jibs, indicated by broken lines. After complete insertion the workpiece is in the position shown in FIG. 1, wherein it is in contact with rolling tools 3.

A stand-by trough 5 is provided in close proximity to the rolls 1, trough 5 supporting a workpiece 4 on the rolling axis x. A pneumatic cylinder 6 with a piston rod 6*a* is arranged behind the trough 5 on the same x axis. An auxiliary trough 7 of V cross section for further workpieces 4" is provided above the x axis, a feeding chute 7*a* forming one of its walls. Such feeding chute 7*a* is attached to a diagrammatically indicated heating device 10 for the workpieces.

Figure 3:
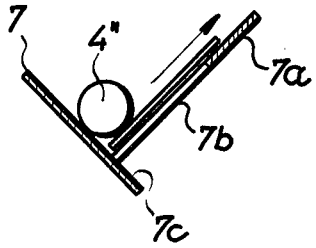
FIG. 3 is a detailed cross sectional view of the auxiliary trough.

The first wall 7*a* of the auxiliary trough 7 has a discharge opening 7*b*, which is closed by a sliding gate 8. Gate 8 is slidable upwards in the feeding chute 7*a* as indicated by the arrow in FIG. 3. The opening 7*b* is located at or at least near the junction of the two walls 7*a* and 7*c* of the auxiliary trough.

The second wall 7*c* of the trough 7 extends downwards and serves as a chute terminating into a box 11 (see FIG. 2) from which it may be returned to the heating device 10 when the mill stand is again in operation.

A pneumatic cylinder 9 with a piston rod 9*a* is situated behind the auxiliary trough 7 in alignment with the lowermost workpiece 4" in the trough 7.

Each of the pneumatic cylinders 6 and 9 is controlled by a respective switch which is actuated by a two-step cam on one of the rolls. In FIG. 1 one such cam 13 is shown, such switch actuating a switch 12.

The above-described apparatus operates as follows:

The rolling mill stand controls the operation of the feeding device as by switches operated in synchronism with the rolls 1, said switches controlling solenoid operated valves for pressure fluid fed to the cylinders 6 and 9. At the time when the forward ends of guiding segments 2 are close to the rolling axis x, an impulse is released for the pneumatic cylinder 6 to shift a workpiece 4' from the stand-by trough 5 by the piston rod 6*a* to a position between the guiding segments 2. When the piston rod 6*a* of the pneumatic cylinder 6 returns to the right of its original position, the apparatus releases an impulse for operation of the pneumatic cylinder 9, which by means of its piston rod 9*a* shifts the workpiece 4" from the auxiliary trough 7 toward the mill stand; the lowermost workpiece 4" then falls into the stand-by trough 5 to be prepared for rolling. This process proceeds at a time when a first workpiece 4 is being rolled.

As soon as the piston rod 9*a* returns to the right to its starting position, a new workpiece 4" falls into the auxiliary trough 7 by way of the feeding chute 7*a*, such workpiece 4" having been expelled from the heating device 10 at a prior predetermined moment.

If the rolling mill comes to a standstill and the heating device 10 must operate continuously, after a certain time of rest the apparatus generates a signal for shifting the sliding gate 8 upwards in the direction of the arrow (FIG. 3); the sliding gate 8 opens the discharge opening 7*b* by way of which the workpiece 4" leaves the trough 7 and falls into the box 11 by way of the discharge chute 7*c*.

The sliding gate 8 remains in its raised, open position until the rolling mill again starts its operation. The sliding gate 8 is controlled by any known mechanical or other device suitable for this purpose in dependence on the operation of the rolling stand.

Although the invention is illustrated and described with reference to one preferred embodiment thereof, it is to be expressly understood that it is in no way limited to the disclosure of such a preferred embodiment, but is capable of numerous modifications with the scope of the appended claims.

What is claimed is:

1. In cross wedge rolling apparatus including a cross wedge rolling mill stand having opposed rolls, the improved mechanism for feeding workpieces to the rolling mill stand, comprising a stand-by trough disposed substantially on the axis of cross rolling, an auxiliry trough above the axis of cross rolling, a supply chute above the auxiliary trough for supplying workpieces to be rolled to said auxiliary trough, the supply chute terminating at the auxiliary trough, a first power cylinder for shifting a workpiece in the auxiliary trough to the stand-by trough, a second power cylinder for shifting a workpiece in the stand-by trough to a position between the opposed rolls of the mill stand, and means selectively to discharge a workpiece from the auxiliary trough before it is fed to the stand-by trough.

2. Apparatus according to claim 1, wherein the means selectively to discharge a workpiece from the auxiliary trough before it is fed to the stand-by trough comprises a discharge opening in a wall of the auxiliary trough at the end of the supply chute, means for selectively opening and closing the discharge opening, and means for guiding the discharged workpiece away from the discharge opening.

3. Apparatus according to claim 2, wherein the auxiliary trough has two opposed walls joined in a generally V formation, the discharge opening is located in one wall of the auxiliary trough adjacent the valley of the trough, the gate means is slidable to open and close the discharge opening, and the means for guiding the discharged workpiece away from the discharge opening comprises a portion of the other wall of the auxiliary trough which extends downwardly below the valley of such trough.

4. Apparatus according to claim 2, comprising means controlled by the operation of the rolling mill stand for operating the gate means.

5. Apparatus according to claim 2, comprising means which opens the gate means at a predetermined time after operation of the rolling mill stand has stopped.

6. Apparatus according to claim 5, comprising means responsive to the operation of the rolling mill stand for operating the first and second power cylinders in sequence.

* * * * *

UNITED STATES PATENT AND TRADEMARK OFFICE

CERTIFICATE OF CORRECTION

PATENT NO. : 4,177,660

DATED : December 11, 1979

INVENTOR(S) : Jan Kovar et al.

It is certified that error appears in the above—identified patent and that said Letters Patent is hereby corrected as shown below:

On the title page, the patent issue date "Dec. 11, 1976" should read -- Dec. 11, 1979 --.

Signed and Sealed this

*Eighteenth* Day of *March 1980*

[SEAL]

*Attest:*

SIDNEY A. DIAMOND

*Attesting Officer*

*Commissioner of Patents and Trademarks*